US010090597B1

(12) United States Patent
Nassar et al.

(10) Patent No.: US 10,090,597 B1
(45) Date of Patent: Oct. 2, 2018

(54) MECHANICALLY RECONFIGURABLE DUAL-BAND SLOT ANTENNAS

(71) Applicants: Ibrahim Turki Nassar, Lake Forest, CA (US); Thomas McCrea Weller, Lutz, FL (US); Craig Perry Lusk, Lutz, FL (US)

(72) Inventors: Ibrahim Turki Nassar, Lake Forest, CA (US); Thomas McCrea Weller, Lutz, FL (US); Craig Perry Lusk, Lutz, FL (US)

(73) Assignee: University of South Florida, Tampa, FL (US)

( * ) Notice: Subject to any disclaimer, the term of this patent is extended or adjusted under 35 U.S.C. 154(b) by 594 days.

(21) Appl. No.: 14/287,487

(22) Filed: May 27, 2014

(51) Int. Cl.
*H01Q 13/10* (2006.01)
*H01Q 11/12* (2006.01)

(52) U.S. Cl.
CPC ..... *H01Q 13/10* (2013.01)

(58) Field of Classification Search
USPC ..... 343/770, 723
See application file for complete search history.

(56) References Cited

U.S. PATENT DOCUMENTS

| | | | |
|---|---|---|---|
| 7,061,447 | B1 | 6/2006 | Bozler et al. |
| 7,724,141 | B2 | 5/2010 | Reynolds |
| 8,369,796 | B2 | 2/2013 | Pan et al. |
| 8,570,223 | B2 | 10/2013 | Arslan et al. |
| 2013/0176177 | A1 | 7/2013 | Cetiner et al. |

FOREIGN PATENT DOCUMENTS

| | | | |
|---|---|---|---|
| WO | 2011072845 | A2 | 6/2011 |
| WO | 2013126124 | A2 | 8/2013 |

OTHER PUBLICATIONS

"Antenna Theory: A Review," Balanis, Proc. IEEE vol. 80 No. 1 Jan. 1992.*
Nassar, et al., "3-D Printed Antenna Arrays for Harmonic Radar Applications", IEEE Wireless Microw. Techn Conf.
Yan, et al., "Intermodulation and Harmonic Distortion in Frequency Reconfigurable Slot Antenna Pairs", IEEE on Antennas and Propagation, vol. 62, No. 3, Mar. 2014.
Nassar, et al., "A Compact 3-D Harmonic Repeater for Passive Wireless Sensing", IEEE Transactions on Microwave Theory and Techniques, vol. 60, No. 10, Oct. 2012.
Nassar, et al., "Radiating Shape-Shifting Surface Based on a Planar Hoberman Mechanism", IEEE Transactions on Antennas and Propagation, vol. 61, No. 5, May 2013.
Weedon, "MEMS-switched reconfigurable antennas," Antennas and Propagation Society International Symposium, 2001. IEEE , vol. 3, No., pp. 654,657 vol. 3, Jul. 8-13, 2001.
Mazlouman, et al. "Pattern reconfigurable square ring patch antenna actuated by hemispherical dielectric elastomer," Electronics Letters , vol. 47, No. 3, pp. 164,165, Feb. 3, 2011.

* cited by examiner

*Primary Examiner* — Graham Smith
(74) *Attorney, Agent, or Firm* — Thomas | Horstemeyer, LLP

(57) ABSTRACT

In some embodiments, a mechanically reconfigurable slot antenna includes an electrically conductive layer having multiple slots, multiple electrically conductive parasitic patches, each patch associated with one of the slots, and a rack-and-pinion mechanism adapted to simultaneously linearly displace at least two of the patches along their associated slots.

20 Claims, 5 Drawing Sheets

MECHANICALLY RECONFIGURABLE DUAL-BAND SLOT ANTENNAS

STATEMENT REGARDING FEDERALLY SPONSORED RESEARCH OR DEVELOPMENT

This invention was made with government support under grant/contract number 1232183 awarded by the National Science Foundation. The government has certain rights in the invention.

BACKGROUND

Reconfigurable microwave antennas are of interest in many applications, providing multi-band, secure, and/or anti-jam communications capability. The primary benefit of such antennas is that multifunctional operation is included in a single design, therefore providing the potential for reduced system size, weight, and cost. Fundamentally, the reconfiguration can be achieved by physical and/or electrical modifications made to the antenna, or by using an impedance matching network that is connected to the antenna. The parameters that may be altered include the operating frequency, radiation pattern, polarization, and beam direction. For example, tuning the resonant frequency of antennas has been demonstrated using diodes, micro-electro-mechanical systems (MEMS), and tunable materials.

In addition to increasing antenna complexity, these techniques may restrict the operational bandwidth and degrade the overall communication performance of the antenna because of the added loss and potential non-linearity induced upon the radio frequency (RF) signal. Some innovative approaches have been proposed to create mechanically reconfigurable antennas in order to lower cost and improve the tunability range. Unfortunately, these approaches generally suffer from the slow speed of the mechanical actuators and their high power consumption.

In view of the above discussion, it can be appreciated that it would be desirable to have improved mechanically reconfigurable antennas.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
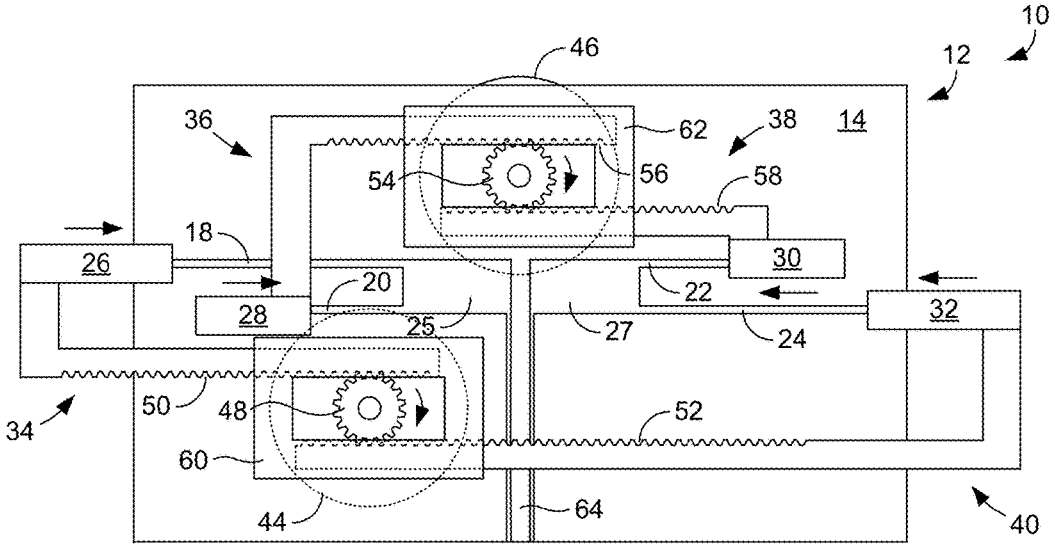
FIG. 1 is a top view of an embodiment of a mechanically reconfigurable dual-band slot antenna.

As described above, it would be desirable to have improved mechanically reconfigurable antennas. Described herein are examples of such antennas. In one embodiment, a mechanically reconfigurable antenna is configured as a dual-band, coplanar waveguide (CPW) fed slot dipole antenna. The antenna comprises multiple slots along which parasitic patches can be linearly displaced to tune the frequencies at which the antenna can receive and transmit. In some embodiments, the antenna comprises four parallel slots, each having its own parasitic patch that can be driven by one or more stepper motors using one or more rack-and-pinion mechanisms.

In the following disclosure, various specific embodiments are described. It is to be understood that those embodiments are example implementations of the disclosed inventions and that alternative embodiments are possible. All such embodiments are intended to fall within the scope of this disclosure.

Frequency reconfigurable and multiband antennas are attractive candidates for modern communication systems including radar, satellite and mobile communications. These antennas have the potential to satisfy the increasing demand for multi-functionality, compact size, and low cost. In comparison to the use of a single wideband antenna, these antennas provide frequency selectivity that is useful for minimizing interference and jamming effects and reduce the complexity and size of the receiver front end. In addition, they provide higher speed alternatives for the conventional installation of multiple antennas on the system. The challenge with the design of these antennas, however, is achieving operation at different frequency bands with consistent radiation characteristics and without degrading the impedance match bandwidth.

Slot dipole antennas are widely used for the purpose of achieving multiband operation. One of the common techniques is to exploit the first higher order mode. Unlike the fundamental mode, the natural radiation pattern of the higher order mode has a null in the broadside direction, although different methods can be introduced to achieve a broadside maximum. For example, coupling slots are shown to be an effective solution while in other embodiments the problem is addressed by using slots of different lengths. Achieving frequency band ratios that are greater than 2 or 3 along with consistent radiation characteristics remains a challenging problem.

An alternative approach to multiband operation is to employ a frequency tunable antenna. In the literature, tunable slot antennas are realized by incorporating different solid state devices such as varactors and PIN diodes, reactive FET components, and shunt switches. In all of these approaches, the tuning range is limited due to the added loss and nonlinearity induced upon the RF signal, and the radiation properties are not preserved over the entire tuning range. In addition to the limited tunability, the use of nonlinear devices may produce undesired signals through the production of harmonic and intermodulation products. To avoid those limitations and improve the tunability range, low cost mechanical reconfiguration methods can be implemented. The drawbacks of these approaches are the slow speed and reliability, compared to the reconfiguration accomplished with electronic devices.

Figure 2:
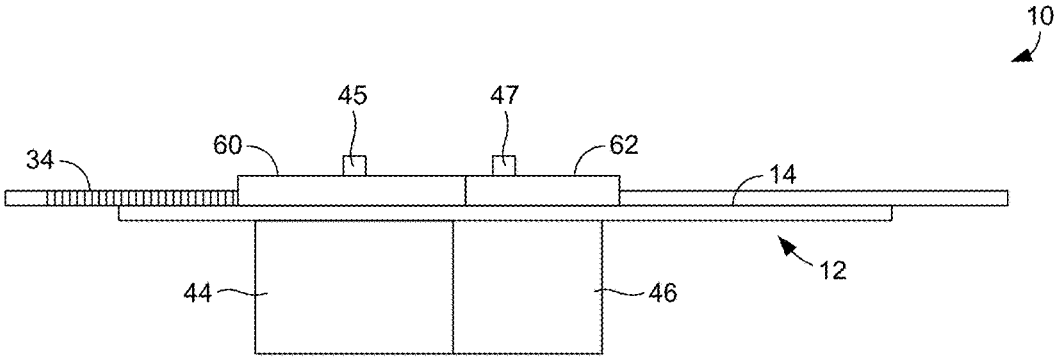
FIG. 2 is a side view of the dual-band slot antenna of FIG. 1.

Disclosed herein are reconfigurable, dual-band, slot dipole antennas. FIGS. 1 and 2 illustrate a mechanically reconfigurable dual-band, slot dipole antenna 10, also referred to herein as a dual-band slot antenna. As shown in these figures, the antenna 10 comprises a nonconductive substrate 12. By way of example, the substrate 12 can be made of acrylonitrile butadiene styrene (ABS). Provided on the top surface of the substrate 12 is an electrically conductive top layer 14, which can be made of a metal material, such as copper, silver, or gold. As shown in FIG. 1, the top layer 14 is patterned so as to define multiple parallel narrow slots, including a first narrow slot 18, a second narrow slot 20, a third narrow slot 22, and a fourth narrow slot 24. In some embodiments, the top layer 14 can be formed using three-dimensional (3D) printing technology by printing silver ink on the substrate 12.

As shown in FIG. 1, the narrow slots 18-24 extend laterally from the opposite ends of relatively wide primary slots 25 and 27, which are positioned near the center of the antenna 10. As indicated in FIG. 1, the primary slots 25, 27 are parallel to each other and their longitudinal axes are aligned with each other. In similar manner, the first slot 18 and the third slot 22 are aligned with each other and their longitudinal axes are aligned with each other, just as the second slot 20 and the fourth slot 24 are aligned with each and their longitudinal axes are aligned with each other.

Positioned above the substrate 12 in contact with its top layer 14 are multiple parasitic patches, including a first parasitic patch 26, a second parasitic patch 28, a third parasitic patch 30, and a fourth parasitic patch 32. Each of these patches 26-32 is made of an electrically conductive material, such as copper, silver, or gold. Each of the patches 26-32 is associated with one of the narrow slots 18-24. More particularly, the first parasitic patch 26 is associated with the first narrow slot 18, the second parasitic patch 28 is associated with the second narrow slot 20, the third parasitic patch 30 is associated with the third narrow slot 22, and the fourth parasitic patch 32 is associated with the fourth narrow slot 24. In the illustrated embodiment, each patch 26-32 is mounted to an end of non-conductive support arm provided on the substrate 12. Specifically, the first parasitic patch 26 is supported by a first support arm 34, the second parasitic patch 28 is supported by a second support arm 36, the third parasitic patch 30 is supported by a third support arm 38, and the fourth parasitic patch 32 is supported by a fourth support arm 40.

In the illustrated embodiment, the support arms 34-40 are linearly displaceable by two stepper motors 44 and 46 that each separately actuate a rack-and-pinion mechanism. Shafts 45 and 47 of the motors 44, 46 are visible in FIG. 2. The first rack-and-pinion mechanism includes a first pinion 48 (in the form of a toothed gear) and two racks 50 and 52 (each comprising a row of teeth) that are formed on the first and fourth support arms 34, 40, respectively, while the second rack-and-pinion mechanism includes a second pinion 54 (in the form of a toothed gear) and two racks 56 and 58 (each comprising a row of teeth) that are formed on the second and third support arms 36, 38, respectively. Each rack is coupled (meshed) with its associated pinion such that rotation of the pinion with a motor causes linear displacement of the rack and, therefore, the associated support arm and parasitic patch. In this manner, the motors 44, 46 can be used to linearly displace the patches 26-32 along the lengths of the slots 18-24 in a desired manner to change the effective lengths of the narrow slots 18-24 and therefore tune the antenna 10. As is further illustrated in FIGS. 1 and 2, support arm guides 60 and 62 can be provided on top of the substrate 12 to guide the support arms 34-40 during such tuning to ensure that they only move in a linear direction that is parallel to the narrow slots 18-24.

The nature of the rack-and-pinion mechanisms enables simultaneous linear translation of two racks in opposite directions. Therefore, if the pinions 48, 54 are rotated in the clockwise direction, as indicated in FIG. 1, each patch 26-32 will be linearly displaced toward the center of the substrate 12. Moreover, because a single rack-and-pinion mechanism is used to simultaneously drive two patches, a pair of patches can be simultaneously displaced the same distance (but in opposite directions). In the illustrated embodiment, the first motor 44 can be used to simultaneously move the first parasitic patch 26 along the first narrow slot 18 and move the fourth parasitic patch 26 along the fourth narrow slot 18. As is shown most clearly in FIG. 3, the first and fourth narrow slots 18, 24 are the relatively long narrow slots. The second motor 46 can be used to simultaneously move the second parasitic patch 26 along the second narrow slot 20 and move the third parasitic patch 30 along the third narrow slot 22. As is shown most clearly in FIG. 3, the second and third narrow slots 18, 24 are the relatively short narrow slots.

With reference back to FIG. 1, the substrate 12 further includes a CPW feed line 64 that is used to feed the antenna 10.

Figure 3:
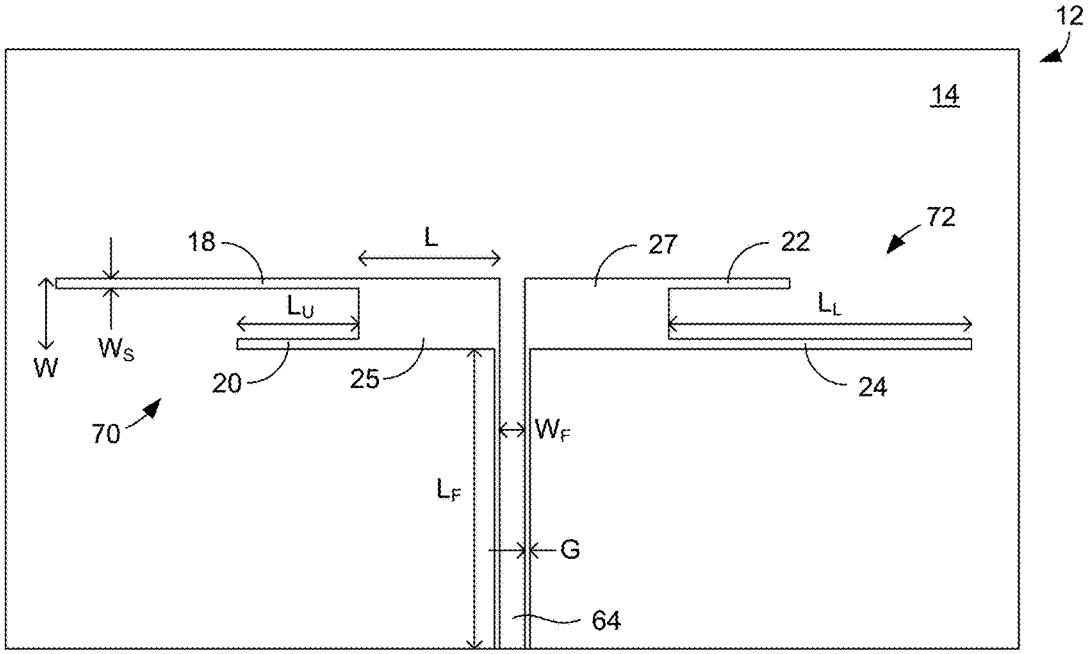
FIG. 3 is a top view of the dual-band slot antenna of FIG. 1 without its parasitic patches and actuating mechanisms.

FIG. 3 shows the substrate 12 separate from the remainder of the antenna structure illustrated in FIGS. 1 and 2 and identifies the dimensions of various features of the substrate 12. As is apparent from FIG. 3, the top layer 14 of the substrate 12 defines two pairs of slots that are inversely symmetrical to each other, including a first slot pair 70 that includes the first and second narrow slots 18, 20, and a second slot pair 72 that includes the third and fourth narrow slots 22, 24. The dual-band operation of the antenna 10 is accomplished by adjusting the primary slot antenna length (L) and configuring the narrow slot pairs in an inversely symmetrical manner around the primary slot axis. The lower band frequency is determined by the effective length of the longer narrow slots, $L_L$, and the length of the primary slot (i.e., $2\times(L_L+L)\approx\lambda/2$), while the upper band frequency is determined by the effective length of the shorter narrow slots, $L_U$, and the length of the primary slot (i.e., $2\times(L_U+L)\approx\lambda/2$). As used herein, $\lambda$ is defined as the wavelength at the frequency band of interest. The width, W, of the primary slots 25, 27 and the width, $W_S$, of the narrow slots 18-24 affects the impedance matching. The size of the top layer 14 and the length of the feed line 64 have minimal impact on the antenna performance. Example antenna dimensions for the configuration shown in FIG. 3 are listed in Table 1.

TABLE 1

| Example antenna dimensions in mm. | |
|---|---|
| W | 7 |
| $W_s$ | 1.0 |
| $L_s$ | 12.1 |
| L | 14 |
| G | 0.3 |
| $L_f$ | 30 |
| $L_L$ | 30.2 |
| $W_f$ | 2.8 |

Because the antenna 10 uses two separate motors 44, 46, it has an arbitrary frequency band ratio. That is, the ratio between the frequency of one band and the other need not be fixed. In some embodiments, the tuning of the frequency band ratio ranges from 1 and 2.6.

Figure 4:
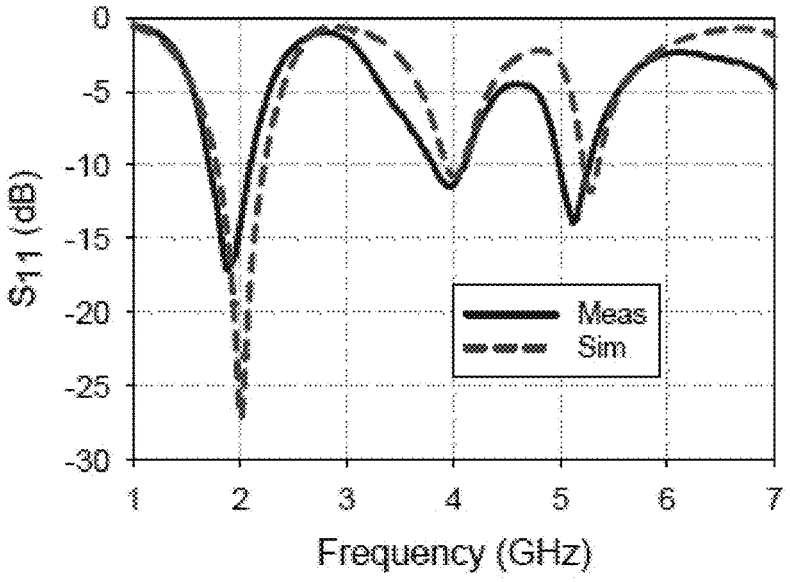
FIG. 4 is a graph that shows the measured and simulated $S_{11}$ of a dual-band slot antenna having a configuration similar to that shown in FIG. 3.
Figure 5:
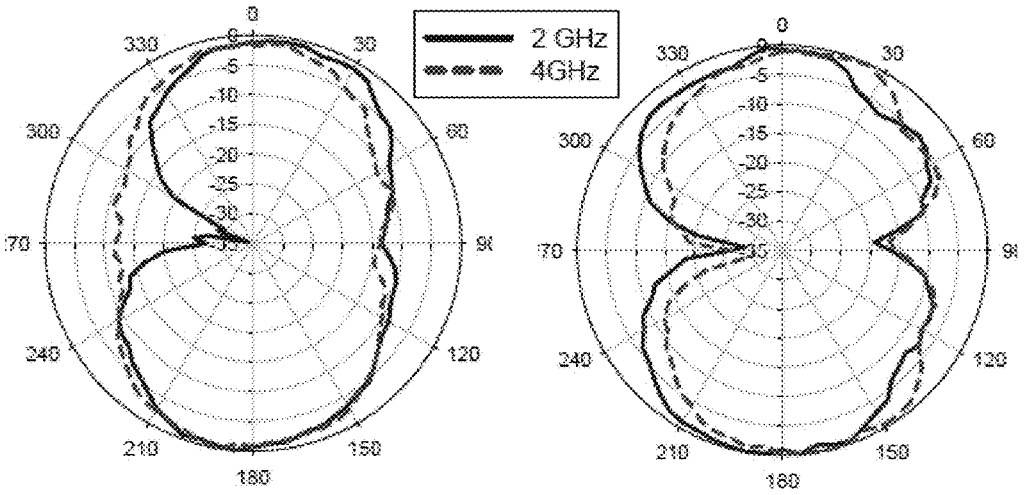
FIG. 5 includes graphs of measured radiation patterns for the dual-band slot antenna having a configuration similar to that shown in FIG. 3 in the H-plane (left) and the E-plane (right).

FIG. 4 shows the measured and simulated $S_{11}$ response for an antenna having the dimensions listed in Table 1. As indicated in this figure, the measured and simulated $S_{11}$ are well matched. The antenna is designed to have the lower band occur at 2 GHz and the upper band to occur at 4 GHz. The 10 dB return loss bandwidth of the lower and upper bands is 17% and 8.25%, respectively. FIG. 5 illustrates the measured E- and H-plane radiation patterns at both of the frequency bands. The antenna exhibits broadside bi-directional radiation pattern with a maximum simulated gain of 4.5 dBi and 7.2 dBi at the lower and the upper bands, respectively. The gain is lower at the lower band due to the smaller electrical size. The antenna is linearly polarized with a measured co-to-cross pol ratio greater than 25 dB at both of the bands.

Figure 6:
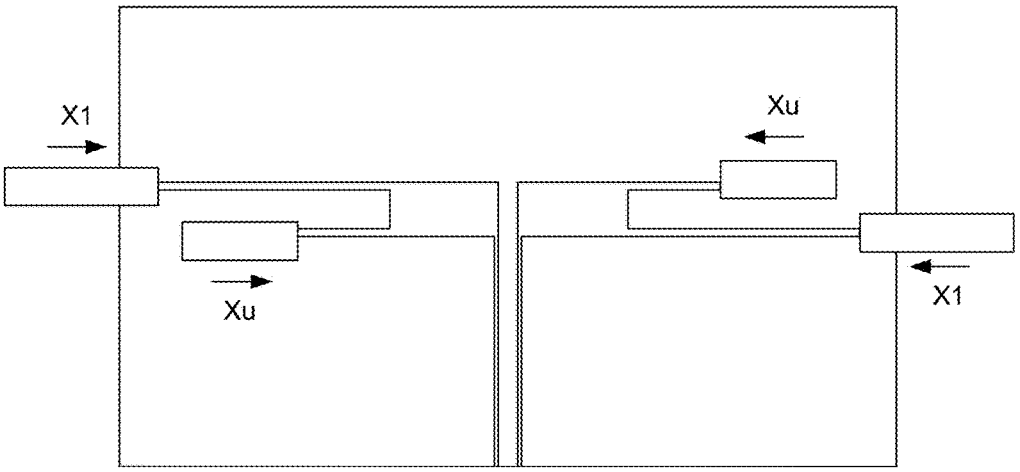
FIG. 6 is a schematic illustration of the geometry of the dual-band slot antenna of FIG. 1 including its parasitic patches and excluding its actuating mechanisms.
Figure 7:
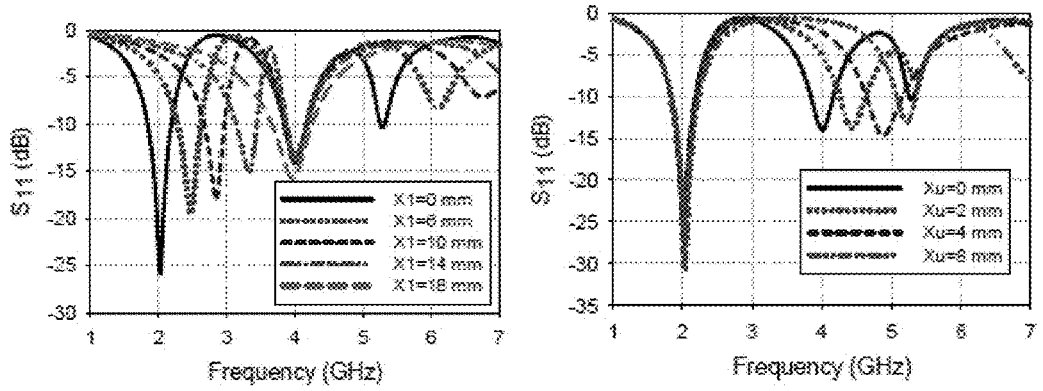
FIG. 7 includes graphs of the simulated $S_{11}$ of the dual-band antenna of FIG. 6 for different X1 and Xu=0 mm (left) and different Xu and X1=0 mm (right).

FIG. 6 schematically illustrates the geometry of the antenna 10. As shown in this figure, parasitic patches are incorporated to independently vary the effective lengths of the relatively long narrow slots and the effective lengths of the relatively short narrow slots. X1 represents the decrease of the lengths of the longer narrow slots and Xu represents the decrease in the length of the shorter narrow slots. FIG. 7 (left) shows the simulated $S_{11}$ for Xu=0 mm and different X1 values. As is apparent from this figure, varying X1 changes the lower band frequency without affecting the upper band. As X1 changes from 0 to 18 mm, the lower band frequency increases up to 4 GHz, which occurs when $L_L$ and $L_U$ are equal. FIG. 7 (right) shows $S_{11}$ performance for X1=0 mm and different Xu values. As Xu changes from 0 to 10 mm, the lower band frequency does not change and the upper band frequency changes from 4 GHz to 5.25 GHz. The upper frequency can increase further if X1 increases simultaneously. By varying X1 and Xu independently, the frequency band ratio can vary between 1 and 2.6.

Figure 8:
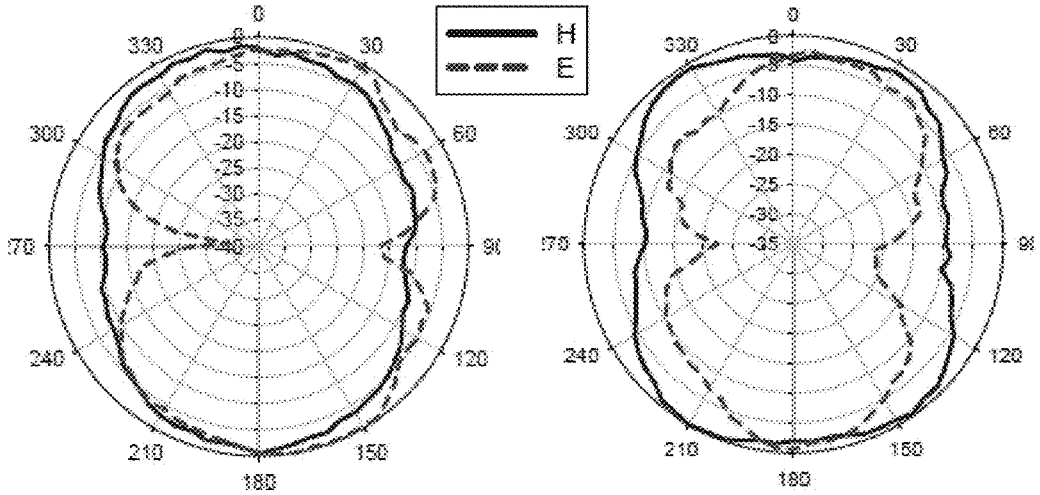
FIG. 8 includes graphs of the measured E- and H-Plane radiation patterns for X1=14 mm and Xu=0 mm at 3.5 GHz (left) and for X1=0 mm and Xu=6 mm at 5 GHz.

FIG. 8 (left) illustrates the simulated E- and H-plane radiation patterns for X1=14 mm and Xu=0 mm at 3.325 GHz. As shown in this figure, the patterns are similar to that shown in FIG. 5. As X1 varies from 0 to 18 mm, the gain varies between 4.5 dBi and 6 dBi. FIG. 8 (right) shows the simulated patterns for X1=0 mm and Xu=10 mm at 5.22 GHz. As is shown in this figure, pattern distortion and a null in the broadside start to occur at the upper frequency limit, however, the peak gain changes by less than 0.6 dB over the tuning range. The axial ratio also remains greater than 22 dB as X1 and Xu vary.

Using the same reconfiguration mechanism, a tunable dual band antenna with a fixed frequency band ratio value can be developed. This design approach can be accomplished using a single actuator and motor to have the parasitic patches simultaneously move together. In this demonstration, the ratio is fixed to a value of 2 to realize a tunable harmonic antenna. These antennas can be used for harmonic radar applications to minimize the radar unit size and reduce the weight. While these antennas have bi-directional patterns that may not be desired for high power radar applications, several approaches can be employed to realize unidirectional radiation including backing the antenna with a cavity, an artificial magnetic conducting reflector, or a closely-spaced ground plane. These approaches, however, may degrade the bandwidth of each band and the tuning range.

Figure 9:
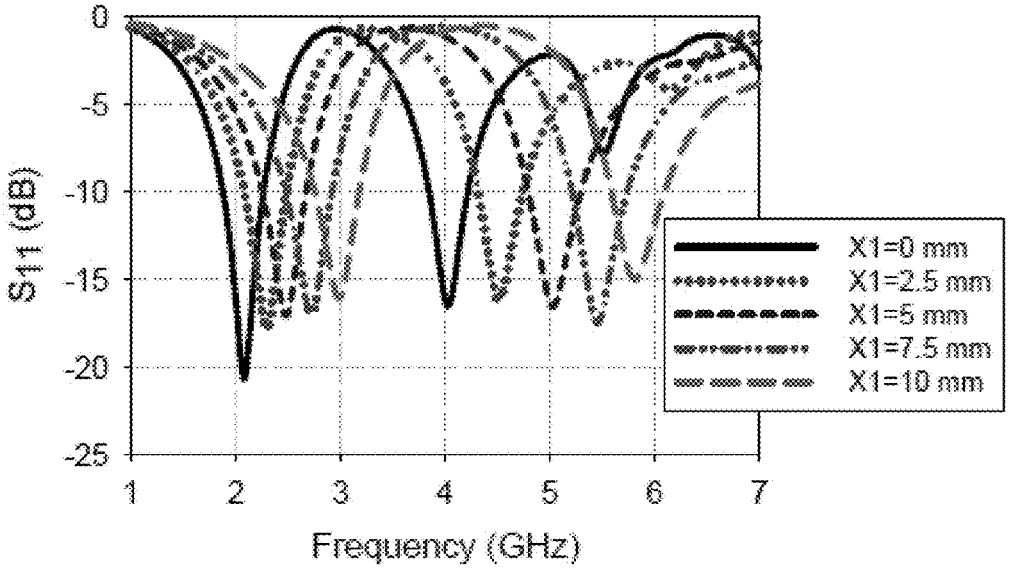
FIG. 9 is a graph that shows the simulated $S_{11}$ of a prototype dual-band antenna for different X1 values.

A prototype antenna having such a configuration was fabricated. In this prototype, the primary slots were meandered and LL and Lu were optimized to be 27.5 and 10.25 mm, respectively, to maintain a frequency band ratio of 2 and good impedance match at both of the bands as X1 varies. FIG. 9 shows the simulated S11 for different X1 values for this antenna. As is apparent from this figure, a frequency ratio of 2 is maintained over the tuning range. As X1 changes between 0 and 10 mm, the lower band frequency changes uniformly between 2 and 3 GHz and the upper band frequency changes between 4 and 6 GHz. While the S11 peak of the second band does not occur exactly at twice the frequency of the first band over the entire range, it falls within the 10 dB return loss (RL) bandwidth (BW) of the second band.

The invention claimed is:

1. A mechanically reconfigurable slot antenna comprising:
an electrically conductive layer having multiple slots;
multiple electrically conductive parasitic patches, each patch associated with one of the slots; and
a rack-and-pinion mechanism adapted to simultaneously linearly displace at least two of the patches along their associated slots.

2. The antenna of claim 1, wherein the electrically conductive layer is formed on a non-conductive substrate.

3. The antenna of claim 1, wherein the electrically conductive layer comprises a wide slot and narrow slots and wherein the parasitic patches are positioned over the narrow slots.

4. The antenna of claim 3, wherein the narrow slots extend from an end of the wide slot.

5. The antenna of claim 4, wherein the electrically conductive layer comprises two wide slots and wherein two narrow slots extend from an end of each of the wide slots.

6. The antenna of claim 5, wherein a short narrow slot and a long narrow slot extends from each wide slot.

7. The antenna of claim 6, wherein the longitudinal axes of the long narrow slots align with the longitudinal axes of the short narrow slots.

8. The antenna of claim 1, wherein the parasitic patches are mounted to support arms that are used to linearly displace the patches.

9. The antenna of claim 8, wherein the rack-and-pinion mechanism drives the support arms.

10. The antenna of claim 9, wherein the rack-and-pinion mechanism comprises a pinion and two racks, each of the racks associated with a support arm.

11. The antenna of claim 10, wherein the pinion comprises a toothed gear and the racks each comprise a row of teeth that mesh with the gear.

12. The antenna of claim 11, wherein the antenna comprises two rack-and-pinion mechanisms, a first rack-and-pinion mechanism that simultaneously linearly displaces two parasitic patches and a second rack-and-pinion mechanism that simultaneously linearly displaces two other parasitic patches.

13. The antenna of claim 11, wherein the rack-and-pinion mechanism simultaneously linearly displaces four parasitic patches.

14. The antenna of claim 1, further comprising a stepper motor that drives the rack-and-pinion mechanism.

15. A mechanically reconfigurable dual-band slot antenna comprising:
a non-conductive substrate;
an electrically conductive layer formed on top of the substrate, the layer defining a first wide slot having an end from which a first short narrow slot and a first long narrow slot extend and a second wide slot having an end from which a second short narrow slot and a second long narrow slot extend, wherein the short narrow slots are used to control the frequency of a first band of the antenna and the long narrow slots are used to control the frequency of a second band of the antenna;

four electrically conductive parasitic patches, each patch positioned over one of the narrow slots;

support arms to which the parasitic patches are mounted; and a rack-and-pinion mechanism adapted to linearly displace the support arms of at least two of the patches so as to displace the patches along their associated narrow slots to change the effective length of the narrow slots and thereby tune the antenna.

16. The antenna of claim 15, wherein the rack-and-pinion mechanism comprises a pinion and two racks, wherein the pinion comprises a toothed gear and the racks each comprise a row of teeth that mesh with the gear.

17. The antenna of claim 15, wherein the antenna comprises two rack-and-pinion mechanisms, a first rack-and-pinion mechanism that simultaneously linearly displaces two of the parasitic patches and a second rack-and-pinion mechanism that simultaneously linearly displaces the other two parasitic patches.

18. The antenna of claim 15, wherein the rack-and-pinion mechanism simultaneously linearly displaces all four parasitic patches.

19. A method for tuning a slot antenna, the method comprising:

linearly displacing parasitic patches along slots of the antenna using a rack-and-pinion mechanism.

20. The method of claim 19, wherein the rack-and-pinion mechanism simultaneously linearly displaces multiple parasitic patches along their associated slots.

* * * * *